US005820301A

United States Patent [19]

Bruckelmyer

[11] Patent Number: 5,820,301

[45] **Date of Patent: *Oct. 13, 1998**

[54] METHOD FOR THAWING FROZEN GROUND

[76] Inventor: Mark Bruckelmyer, 5617 McQuade Rd., Duluth, Minn. 55804

[ * ] Notice: The term of this patent shall not extend beyond the expiration date of Pat. No. 5,567,085.

[21] Appl. No.: 683,668

[22] Filed: Jul. 17, 1996

Related U.S. Application Data

[63] Continuation-in-part of Ser. No. 504,526, Jul. 20, 1995, Pat. No. 5,567,085.

[51] Int. Cl.[6] ..... E02D 3/11

[52] U.S. Cl. ..... 405/229; 405/131

[58] Field of Search ..... 405/229, 234, 405/131, 250; 52/741.1, 741.15, 411.11

[56] References Cited

U.S. PATENT DOCUMENTS

| | | | |
|---|---|---|---|
| 462,179 | 10/1891 | Turley et al. . | |
| 1,587,984 | 6/1926 | Pearce . | |
| 3,195,619 | 7/1965 | Tippman | 405/234 X |
| 3,293,866 | 12/1966 | Cox et al. . | |
| 3,758,748 | 9/1973 | Reid . | |
| 3,762,171 | 10/1973 | Bjorheim et al. | 405/131 |
| 3,791,443 | 2/1974 | Burt et al. | 405/131 X |
| 3,868,825 | 3/1975 | Boyce . | |
| 3,976,125 | 8/1976 | Best . | |
| 4,314,772 | 2/1982 | Lestraden | 405/229 X |
| 4,349,010 | 9/1982 | Bentham . | |
| 4,646,818 | 3/1987 | Ervin, Jr. . | |
| 5,120,158 | 6/1992 | Husu . | |
| 5,181,655 | 1/1993 | Bruckelmyer . | |
| 5,567,085 | 10/1996 | Bruckelmyer | 405/229 |

*Primary Examiner*—Tamara L. Graysay
*Assistant Examiner*—Frederick L. Lagman
*Attorney, Agent, or Firm*—Palmatier, Sjoquist, Voigt & Christensen, PA

[57] ABSTRACT

The object of the present invention to provide a method for thawing frozen ground for laying concrete primarily at a construction site by use of a continuous length of circulating hose placed on the frozen ground inside and/or adjacent a concrete form or over the area where the concrete will be laid, covering the circulating hose with a layer of aggregate material for insulation from cold air leaving the ends of the circulating hose protruding from the aggregate connecting the ends of the hose to a source of heated liquid to circulate warm liquid through the circulating hose to thaw the frozen ground, laying the concrete over the identified area while continuing to circulate heated liquid in the circulating hose to prevent the concrete from freezing, leaving the portion of the hose in the aggregate under the concrete by cutting the ends protruding from the aggregate, removing the remaining portions of the hose.

8 Claims, 3 Drawing Sheets

METHOD FOR THAWING FROZEN GROUND

This is a continuation-in-part application based on U.S. patent application Ser. No. 08/504,526, filed Jul. 20, 1995, now U.S Pat. No. 5,567,085.

BACKGROUND OF THE INVENTION

The present invention relates to a method for thawing frozen ground, or for preventing the ground from becoming frozen, for laying concrete and is uniquely adapted for use at construction sites for various ground-thawing purposes.

In northern climates, there is a need for a method of thawing frozen ground for laying concrete in the construction industry. In construction work such laying of concrete is severely hampered in cold weather, because the concrete tends to be difficult to maintain in usable form and may not harden properly if it freezes before the concrete sets up.

Ground frost in frozen ground at a construction site poses a problem when laying concrete footings, floors and the like. Concrete laid on top of frozen ground may be subject to freezing before it has time to set up. Concrete laid on frozen ground may also become cracked or deformed due to settling of the ground after the ground thaws. It is also very expensive and time consuming to remove frost prior to laying concrete. Ground frost increases cost of construction due to time lost by contractors, plumbers and electricians who cannot work until the concrete is laid.

It is the object of the present invention to provide an inexpensive flexible method of thawing frozen ground for laying concrete.

SUMMARY OF THE INVENTION

The object of the present invention is to provide a method for thawing frozen ground for laying concrete primarily at a construction site by use of a continuous length of circulating hose placed on the frozen ground inside and/or adjacent a concrete form where the concrete will be laid, covering the circulating hose with a layer of aggregate material for insulation from cold air leaving the ends of the circulating hose protruding from the aggregate, connecting the ends of the hose to a source of heated liquid to circulate warm liquid through the circulating hose to thaw the frozen ground, laying the concrete in the concrete form while continuing to circulate heated liquid in the circulating hose to prevent the concrete from freezing, leaving the portion of the hose in the form under the concrete by cutting the ends protruding from the aggregate, removing the remaining portions of the hose. The method is also useful for preventing ground from becoming frozen, or in situations where no concrete forms are used.

A feature of the present invention is a method of thawing frozen ground which is flexible and adaptable to contours of the frozen ground.

Another feature of the invention is the method of using a continuous length of circulating hose requiring only connections to be made to a supply of hot liquid and a drain.

Another feature of the invention is the method of distributing the circulating hose in a random fashion to accommodate contours in the construction site.

Another feature of the invention is the method of leaving the circulating hose under the concrete and cutting the ends of the circulating hose protruding from the aggregate or laid concrete.

Another feature of the invention is a method of circulating warm liquid through the circulating hose after the concrete is laid to prevent freezing while the concrete hardens.

An advantage of the present invention is a simple, quick installation due to the continuous length of flexible circulating hose.

Another advantage of the present invention is the method of thawing frozen ground for laying concrete which does not require removal prior to laying concrete.

Another advantage of the present invention is the method of preventing concrete from freezing after it has been laid.

DETAILED SPECIFICATION

Figure 1:
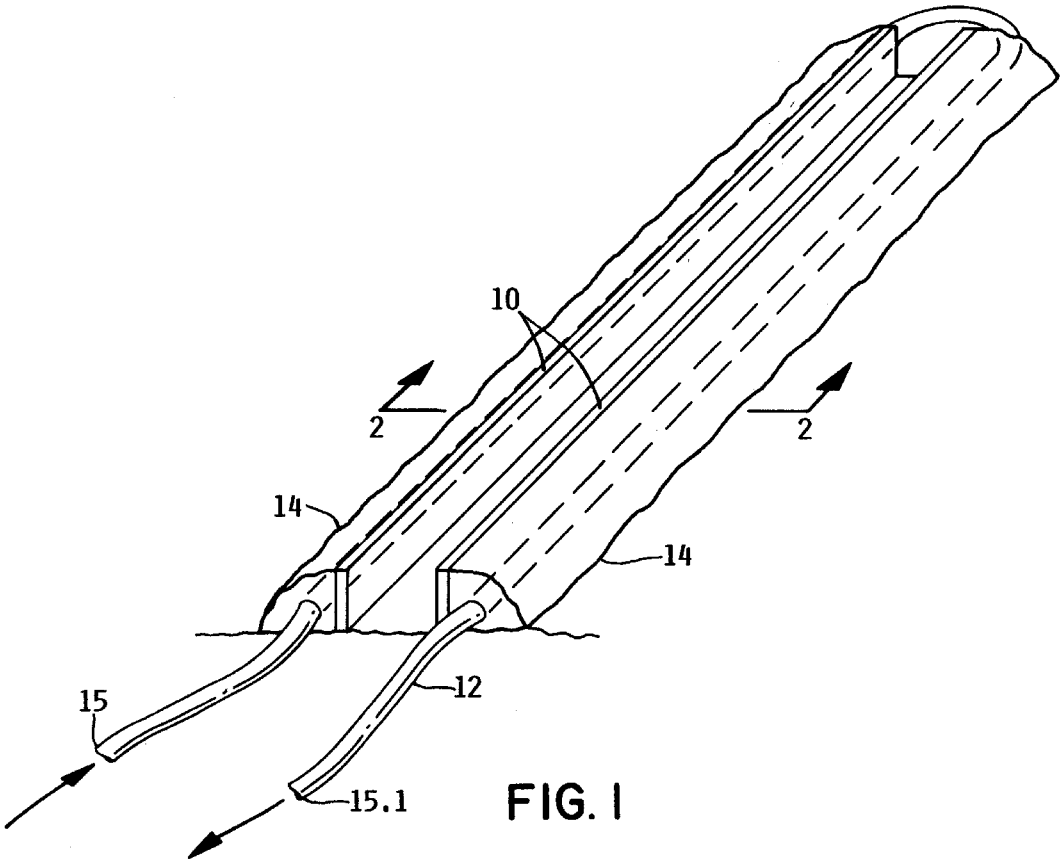
FIG. 1 shows an isometric view of a concrete footing form which is surrounded by a circulating hose covered with aggregate.

FIG. 1 illustrates an isometric view of a concrete footing form 10 which is then set on the ground prior to laying concrete. A continuous length of warm liquid circulating hose 12 is placed on the ground adjacent to and surrounding form 10. The circulating hose 12 has a diameter suited for the depth of the frozen ground to be thawed. Circulating hose 12 is covered by a layer of aggregate material 14 such as sand or gravel to provide insulation from the cold environment. It should be understood that a circulating hose 12 having a smaller diameter requires a smaller quantity of aggregate 14 to cover and insulate. The diameter of circulating hose 12 and the volume, flow rate and temperature of the heated liquid will affect the rate of thawing of frozen ground. In the preferred embodiment, uninsulated rubber or plastic circulating hose 12 is used having a length sufficient to extend in a pattern over the ground to be thawed with both ends 15, 15.1 protruding from the aggregate 14 for connection to a source of heated liquid.

In the preferred embodiment, circulating hose 12 is a flexible, single piece continuous length laid in a linear fashion to conform to the contours of the frozen ground to be thawed. Circulating hose 12 may have a length exceeding several thousand feet. Circulating hose ends 15, 15.1 protrude from the aggregate 14 for connection to a source of heated liquid (not shown) and a drain or return line. A heated liquid such as water or antifreeze is then circulated through circulating hose 12 to thereby thaw the underlying ground. Liquid such as water may be circulated continuously or forced into circulating hose 12 at one end 15 and allowed to drain away from concrete form 10 at end 15.1. The radiation of heat from the heated liquid circulating through circulating hose 12 will thaw the frozen ground under the aggregate 14 under concrete form 10.

Figure 2:
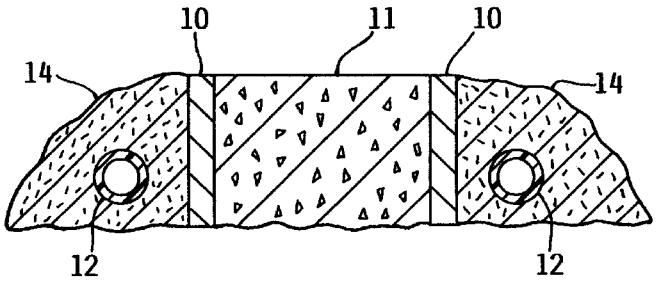
FIG. 2 shows a section view taken at approximately 2—2 of FIG. 1.

FIG. 2 is a section view of the method of laying concrete on frozen ground illustrating the relationship of the circulating hose 12 and concrete form 10. Aggregate 14 is piled over circulating hose 12 to a depth sufficient to minimize heat loss due to the cold environment, and concrete 11 is poured into the space defined by form 10.

Figure 3:
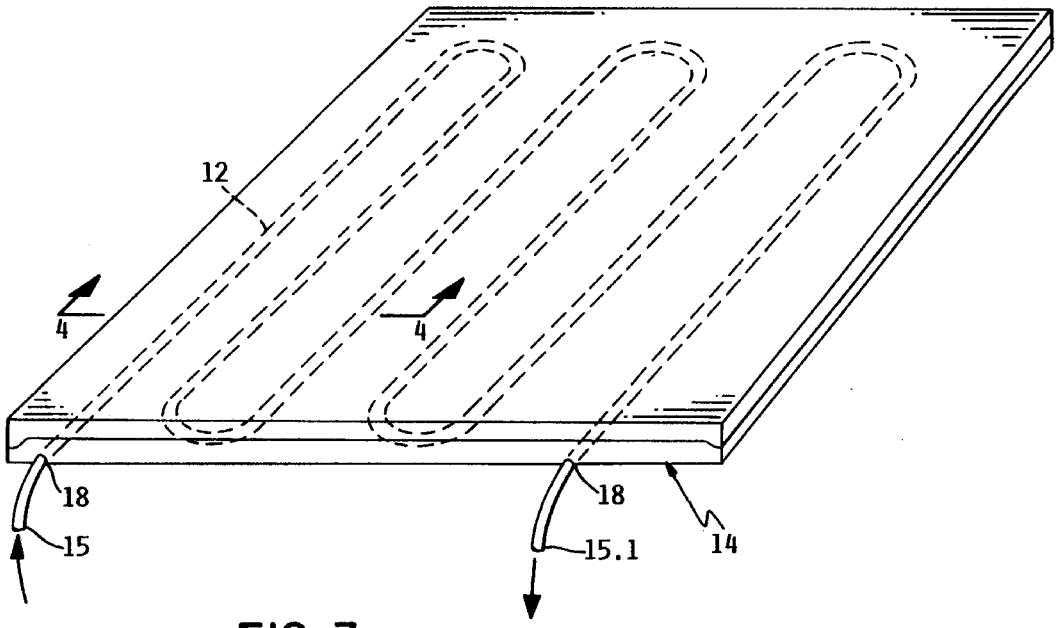
FIG. 3 shows an alternate embodiment wherein the method for thawing frozen ground for laying concrete is applied to a large area.

FIG. 3 shows an alternative and preferred embodiment of the method of laying concrete on frozen ground wherein a large section of ground is to be thawed. Circulating hose 12 is laid on the frozen ground in a pattern of parallel lines spaced 12 to 24 inches apart. This measurement is intended to illustrate the preferred embodiment and is not in any way intended to limit the scope of the invention. The distance between portions of circulating hose 12 may be smaller or larger depending on environmental conditions, circulating hose diameter, temperature of the heated liquid and the desired rate of thawing the frozen ground.

A layer of aggregate 14 is placed over the circulating hose 12 within concrete form 10 to a depth of 6 to 10 inches to insulate circulating hose 12 from the cold environment. The depth of aggregate 14 illustrates the preferred embodiment and may vary based on environmental conditions and other factors and is not intended to limit the scope of the invention. Circulating hose ends 15, 15.1 are then connected to a source of heated liquid such as antifreeze or water. Circulating hose end 15 is used to introduce heated liquid to circulating hose 12, circulating hose end 15.1 is used to drain the liquid from circulating hose 12, the liquid may be reheated and pumped into circulating hose 12 again through circulating hose end 15. Heated liquid is directed through circulating hose 12 to thereby thaw the underlying ground by heat radiated from the heated liquid. Aggregate 14 insulates the ground and circulating hose 12 from the cold environment. Aggregate 14 prevents the ground from refreezing and maximizes the thawing effect of the heated liquid on the frozen ground.

Figure 4:
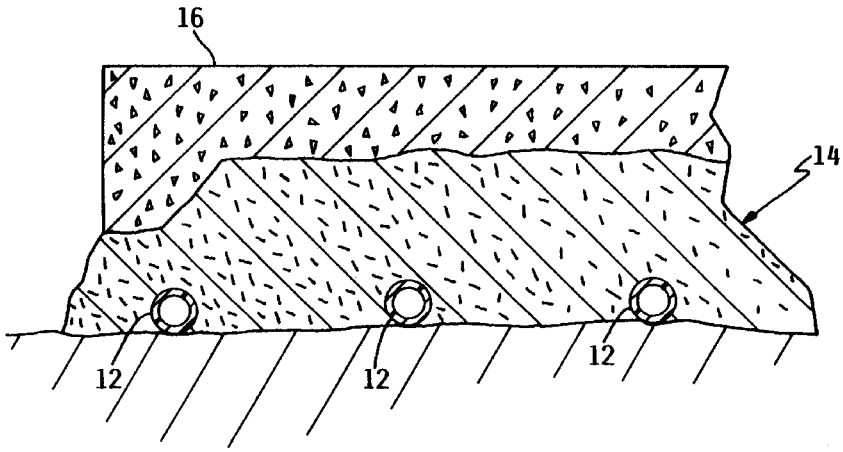
FIG. 4 is a section view taken at approximately 4—4 of FIG. 3.

In the preferred embodiment illustrated in FIGS. 3 and 4, concrete 16 is laid on top of aggregate layer 14. Circulating hose 12 is left under aggregate 14 and concrete 16. Hot liquid continues to circulate in circulating hose 12 to prevent concrete 16 from freezing while concrete 16 hardens. Circulating hose 12 is cut at points 18 where it protrudes from aggregate 14 and is permanently left in aggregate 14 under concrete 16. Alternatively, circulating hose 12 may be cut at point 18 before laying concrete 16 or before concrete 16 hardens.

In the preferred embodiments of FIGS. 1 and 2, the hose 12 may not be overlaid by concrete; and, therefore, may be removed from the aggregate 14 after the need for ground thawing passes. In some construction situations, the embodiment of FIGS. 3 and 4 may permit the hose 12 to be removed prior to pouring the concrete 16. In such cases, as for example a basement floor in a building construction, the hose is laid beneath the aggregate 14 during the portion of the construction phase when the building is open to the weather. Near the end of the construction phase, it is frequently possible to have the building structure enclosed, as to have heat generated within the building for further interior work. If this occurs, it may be possible to remove the hose 12 from the aggregate after the building has received interior heat but before the laying of the concrete floor. However, even in this event, the use of the invention enables the concrete laying work to proceed immediately without having to wait an extended time for the interior heating to thaw the ground beneath the floor.

Figure 5:
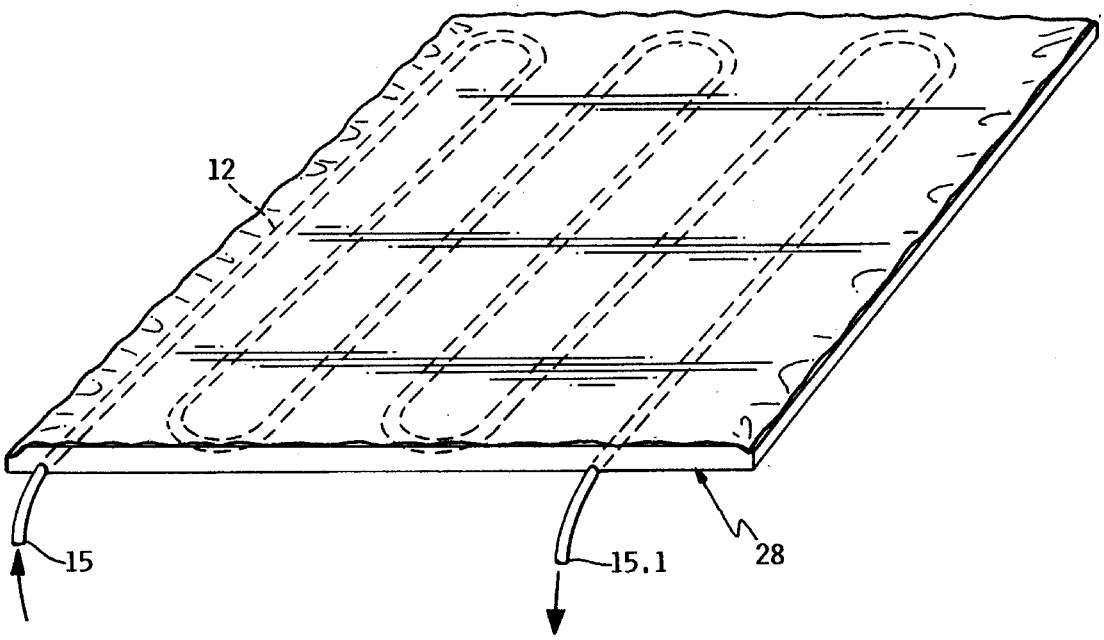
FIG. 5 shows an alternative embodiment for thawing frozen ground.

In some cases, other types of insulation may be used, other than aggregate, to confine and direct heat into the ground. For example, a fiberglass or polypropylene blanket 28 may be overlaid on top of the hose. Also, hay or straw may sometimes be used as the insulation. FIG. 5 shows an alternative embodiment for thawing ground, wherein an insulation blanket 28 is laid over the hose 12 after the hose 12 has been laid upon the surface area of the ground which is identified for thawing. The hose 12 is first laid upon the identified ground surface area in either a random or identified pattern, and then the insulation blanket 28 is overlaid over the entire identified area. The ends of the hose 12 are connected to a source of warm liquid at 15, 15.1, to permit the liquid to circulate through the hose beneath the insulation blanket 28. After a sufficient period of time, the ground in the identified area beneath the insulation blanket 28 becomes thawed; and the hose and blanket 28 may be removed from the identified surface area for subsequently pouring concrete over the identified surface area. Alternatively, the identified surface area could simply be thawed for purposes of permitting a digging operation in the identified area.

The present invention may be embodied in other specific forms without departing from the spirit or essential attributes thereof; and it is, therefore, desired that the present embodiment be considered in all respects as illustrative and not restrictive, reference being made to the appended claims rather than to the foregoing description to indicate the scope of the invention.

What is claimed is:

1. A method of laying concrete on an area of frozen ground comprising:

(a) identifying the area for laying the concrete;

(b) placing a portion of a continuous length of heated liquid circulating hose on the ground over the identified area, extending the ends of the circulating hose to protrude outside the identified area;

(c) covering the portion of circulating hose on the identified area with an aggregate material;

(d) directing warm liquid through the circulating hose;

(e) laying concrete over the identified area, and over the aggregate material and circulating hose; and (f) severing the protruding ends of the circulating hose whereby the concrete is laid over the ground thawed by radiant heat from the warm liquid in the circulating hose leaving the portion of the circulating hose under the concrete.

2. The invention of claim 1, wherein the warm liquid is circulated continuously until the concrete hardens.

3. The invention of claim 1, wherein the circulating hose is laid in a pattern of parallel rows to effectively thaw the identified area.

4. The invention of claim 1, wherein the circulating hose is laid in a pattern comprising parallel rows 12 to 24 inches apart.

5. A method for thawing an area of frozen ground without penetration into the ground, consisting essentially of the steps of:

(a) identifying an area of ground for thawing;

(b) placing a portion of a continuous length of hose on the surface of the ground over the identified area in a pattern, without penetration of the hose into the ground, substantially uniformly overlaying said identified area, extending the ends of the hose outside the identified area;

(c) covering the portion of hose in the identified area with an insulation blanket;

(d) circulating warm liquid through the hose until the ground in the identified area becomes thawed from the surface downwardly; and (e) removing the insulation blanket and hose from the identified area.

6. The method of claim 5, wherein the insulation blanket further comprises polypropylene material.

7. The method of claim 5, wherein the insulation blanket further comprises fiberglass material.

8. The method of claim 5, wherein the insulation blanket further comprises hay or straw.

* * * * *